United States Patent [19]

Geberth, Jr.

[11] 3,936,002

[45] Feb. 3, 1976

[54] ADJUSTABLE SPRAY TIP

[76] Inventor: John D. Geberth, Jr., Rifle Camp Road, West Paterson, N.J. 07424

[22] Filed: Nov. 29, 1974

[21] Appl. No.: 528,558

[52] U.S. Cl. ..... 239/455; 239/437; 239/443; 239/586

[51] Int. Cl.[2] ..... B05B 1/32

[58] Field of Search ..... 239/393, 395, 437, 443, 239/451, 455, 569, 586

[56] References Cited

UNITED STATES PATENTS

| | | | |
|---|---|---|---|
| 1,272,263 | 7/1918 | Hooker | 239/586 |
| 1,703,219 | 2/1929 | Wold | 239/443 X |
| 2,419,228 | 4/1947 | Pitre et al. | 239/455 |
| 3,414,196 | 12/1968 | Legeza et al. | 239/395 X |
| 3,667,681 | 6/1972 | Blancha | 239/393 |
| 3,836,082 | 9/1974 | Krohn | 239/569 X |
| R13,366 | 2/1912 | Bowers | 239/451 |

*Primary Examiner*—Robert S. Ward, Jr.
*Attorney, Agent, or Firm*—Joseph J. Orlando

[57] ABSTRACT

An adjustable spray tip or nozzle is provided for a spray gun and like devices which are adapted to hydraulically atomize and spray liquids such as paint, said spray tip including means for adjusting the fan spray issuing therefrom. The adjusting means in the spray tip includes a valve for controlling the fluid passing through the spray opening.

14 Claims, 12 Drawing Figures

FIG. 8
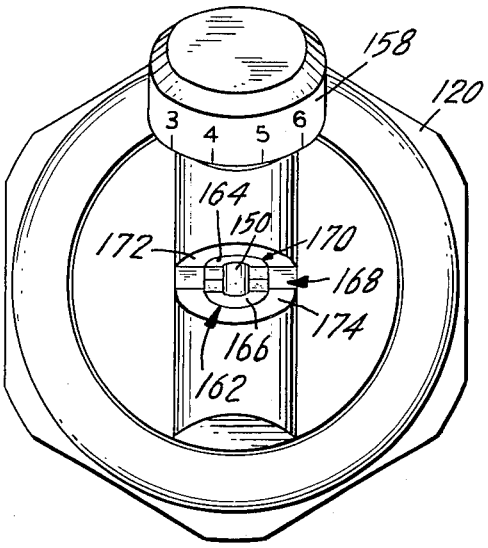
FIG. 7
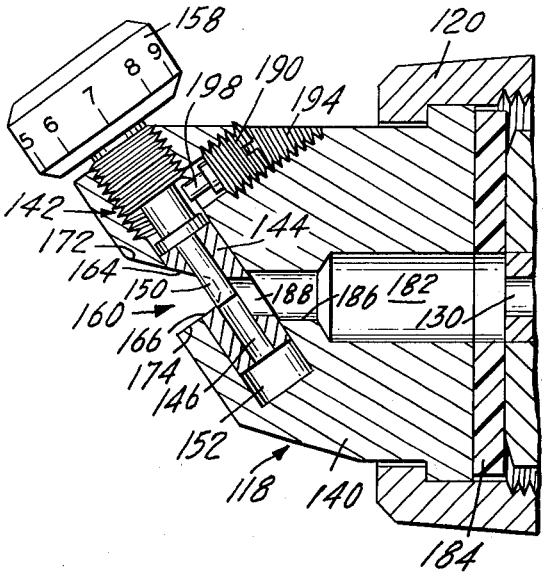
FIG. 9
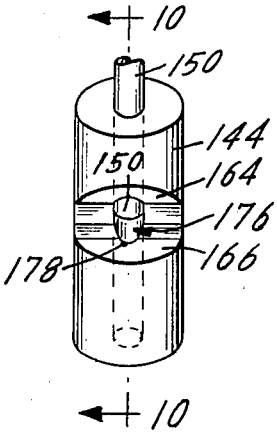
FIG. 10
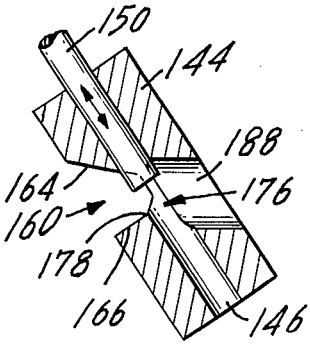
FIG. 11
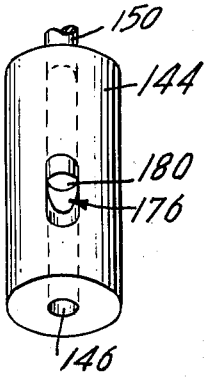
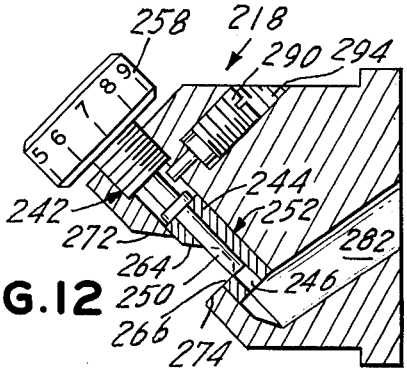
FIG. 12

ADJUSTABLE SPRAY TIP

The present invention relates generally to spray guns and like devices for hydraulically atomizing and spraying liquids such as paint and, more particularly, it relates to such a device having a novel and improved spray tip which permits adjustment of the fan spray issuing from the spray opening.

Previously, the principal system employed in spraying paint onto a surface utilized high-pressure air escaping through a nozzle together with the liquid paint which was thereby atomized resulting in a fan spray. However, an alternative to this system was found necessary, first to provide a faster method of spraying paint, and second to eliminate much of the waste encountered due to the carrying away of paint and solvents by escaping air. Thus, the airless or hydraulic method of paint atomization was developed. In accordance with this method, a spray gun or other such device is provided, which includes a passageway adapted to be connected to a source of paint or other liquid under high pressure, a valve body having a valve port in the passageway with a valve member arranged to seat on the upstream side of the valve port to thereby interrupt the flow of paint, and a spray nozzle secured to the spray gun on the downstream side of the valve body. The valve port and all other passages upstream from the nozzle are maintained substantially larger than the nozzle opening in order to minimize pressure drop and flow restriction and to impose high pressure on the nozzle in an effort to attain atomization of the liquid being sprayed. The paint or other liquid reaches the nozzle under high pressure and with low velocity and is accelerated in the nozzle opening to the high velocity and low pressure of the fan spray.

This hydraulic atomization system of spraying insures that substantially all of the paint which is sprayed is applied to the surface being painted, thus greatly reducing paint losses. In addition, the paint is sprayed at a greater rate than with the high-pressure air system. However, along with these benefits certain disadvantages have become apparent. One such disadvantage relates to the inability or difficulty in adjusting the spray issuing from the nozzle of the spray gun. With the air atomization system, adjustability is accomplished by means of a tapering needle valve which controls the amount of liquid paint which comes into contact with and which is atomized by the high-pressure air passing through the nozzle. In the case of the hydraulic atomization system, if a similar means were employed to control the amount of fluid, excessive wear of the valve and needle would necessarily result since the orifices involved are smaller by a factor of about ten as compared to the pressurized air system resulting in greatly increased flow velocities. In addition, the use of such a valve system results in objectionable clogging at the valve port due to the small clearances available and the size of the paint particles involved.

Another disadvantage of the hydraulic atomization system is that the nozzle opening, because of its small dimension, is susceptible to clogging with the particles carried in the paint being sprayed. This is not a problem in the air spraying system since the nozzle opening in the spray tip is substantially larger than in the hydraulic atomization system. One system presently employed for clearing nozzles in hydraulic spray guns permits the nozzle to be revolved 180° so that the forward part of the nozzle faces the high-pressure paint. This permits the paint to flow through the nozzle in a direction which is opposite to its normal flow to thereby dislodge the particle causing the blockage. However, this system of unclogging such nozzles is unattractive because of the numerous moving parts, which are subject to wear, and by the high cost. In addition, since the frontal face of the nozzle is turned toward the high-pressure paint, the paint issues from the rear of the nozzle in a stream rather than as a spray. Thus, is the spray gun is pointed at the surface being painted, a blob of paint will strike the surface causing the paint to run and resulting in an unsightly finish.

It is, therefore, a primary object of the present invention to provide a spray tip or nozzle for a spray gun or similar device, adapted to hydraulically atomize and spray liquids such as paint, which permits easy adjustment of the volume of liquid sprayed, and of the fan spray, and which is easily and simply cleared when clogged.

The above object, as well as others which will hereinafter become apparent, is accomplished in accordance with the present invention by the provision of an adjustable spray tip or nozzle for a spray gun and like devices which are adapted to hydraulically atomize and spray liquids. Briefly, the adjustable spray tip or nozzle of the present invention is mounted to a spray gun through which extends a passageway communicating with a source of liquid under pressure. The spray tip comprises a body portion, a valve bore extending partially through said body portion, a groove in the spray tip body intersecting said valve bore to thereby form a spray or nozzle opening, and a fluid bore in the body portion which communicates with the valve bore and with the passageway, thereby permitting pressurized liquid to be transferred from the source thereof to the valve bore. For the purpose of adjusting the spray issuing from the nozzle opening, a valve stem is provided whch is moveable in the valve bore to vary the nozzle opening thereby varying the volume of paint sprayed and, depending upon the shape of the nozzle opening, to simultaneously vary the width of the fan spray.

The present invention will be described and understood more readily when considered together with the embodiments shown in the accompanying drawings, in which:

FIG. 7 is a cross-sectional view of another embodiment of the spray tip according to the present invention;

FIG. 8 is a front elevational view of the spray tip of FIG. 7;

FIG. 9 is a front elevational view of a portion of the adjustable valve of the spray tip shown in FIG. 7;

FIG. 10 is a cross-sectional view of the portion of the adjustable valve shown in FIG. 9;

FIG. 11 is a rear-elevational view of the portion of the adjustable valve shown in FIG. 9; and FIG. 12 is a cross-sectional view of yet another embodiment of the spray tip according to the present invention.

Figure 6:
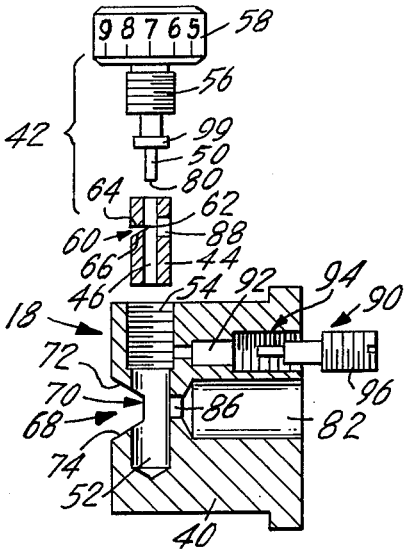
FIG. 6 is an exploded view of the spray tip according to the present invention.
Figure 1:
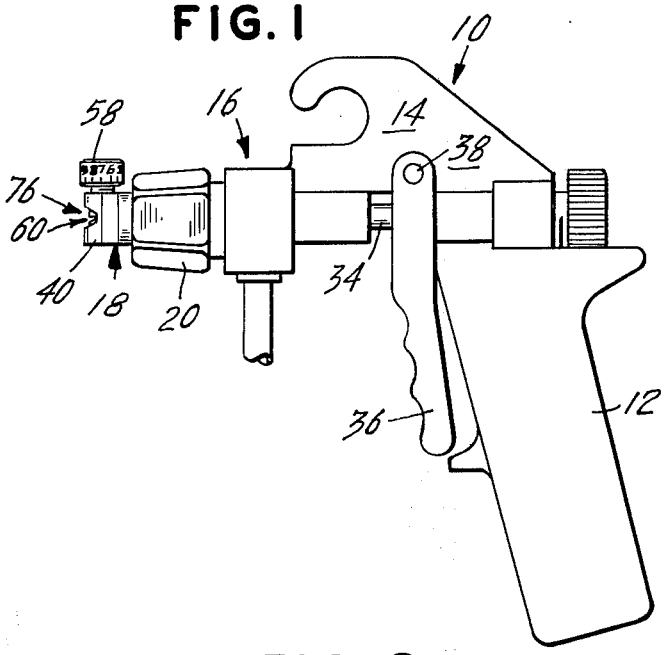
FIG. 1 is a side elevational view of a spray gun having a spray tip according to the present invention.
Figure 2:
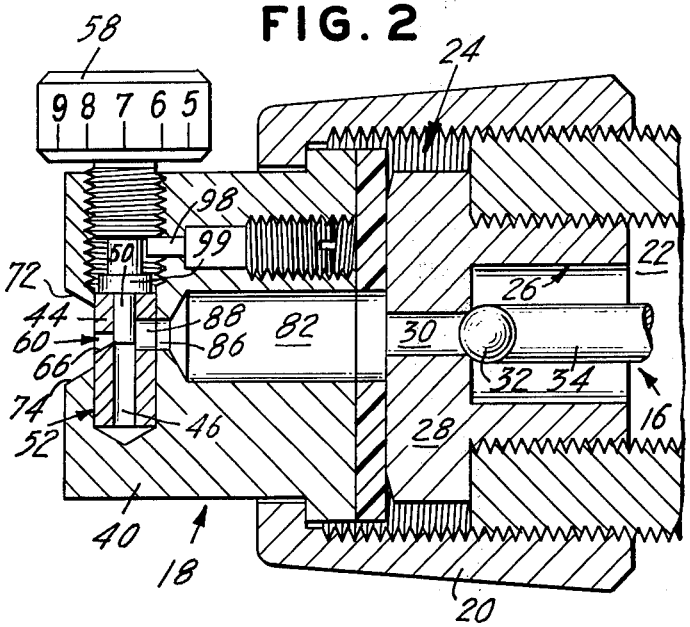
FIG. 2 is a cross-sectional view of a portion of the spray gun of FIG. 1 showing primarily the spray tip according to the present invention.
Figure 5:
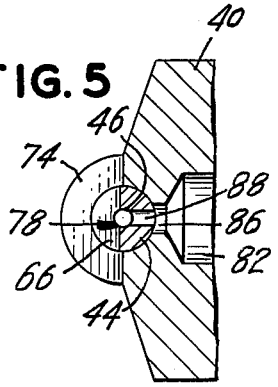
FIG. 5 is a cross-sectional view of a portion of the spray tip taken along line 5-5 of FIG. 4.

Referring now to the drawings, there is shown in FIG. 1 a spray gun, generally designated 10, adapted for hydraulically atomizing and spraying paint. It is to be appreciated that the present invention may be utilized with spray devices other than spray guns, but for the sake of simplicity the present description will be confined to spray guns. Spray gun 10 comprises a handle portion, generally designated 12, a body portion, designated 14, and a spray portion, designated 16. Spray portion 16 includes spray tip 18 secured to body portion 14 by retaining nut 20, a conduit, generally designated 22, connected to a reservoir of paint (not shown) maintained under high pressure and, as seen in FIG. 2, a valve, generally designated 24. A fluid passage, designated 26, in spray portion 16, connects valve 24 with conduit 22 so that passage 26 and conduit 22 are always completely filled with paint under high pressure.

Valve 24 consists of a housing portion, generally designated 28, and a valve port, designated 30, which passes centrally through housing 28 and which communicates with the upstream side of spray tip 18. The port 30 of valve 24 is adapted to be closed on its upstream side by a ball or needle valve 32 carried on axially extending valve stem 34. Ball valve 32 is actuated by the movement of trigger 36 which is pivotally mounted at 38 to body 14 of spray gun 10 and which is adapted to axially move valve stem 34. Ball valve 32 is maintained in the seated position on valve port 30 by resilient means (not shown) acting on valve stem 34, said resilient means being overcome by pressure applied to trigger 36 by the operator.

Spray tip 18 of the present invention is clearly depicted in FIGS. 2 to 6 and basically comprises a spray tip housing, generally designated 40, and an adjustable spray valve, generally deignated 42. As is clearly seen in FIG. 6, adjustable spray valve 42 is comprised of a valve housing, designated 44, a preferably circular valve bore 46 extending therethrough, and an adjustable valve means 48 including a stem portion 50 extendable into bore 46. It has been found that for proper operation the clearance of stem 50 in bore 46 must be very close and preferably no greater than 0.0004 inches. Housing 40 is provided at its forward or paint-exiting end with a bore, generally designated 52, which is substantially perpendicular to the horizontal plane of the axis of spray gun 10, and into which valve housing 44 is press fit. The upper portion of bore 52 is threaded at 54 to accept the threaded portion 56 of valve means 48. Valve means 48 additionally includes adjusting knob 58 which, as clearly seen in FIG. 2, when turned will cause stem portion 50 of valve means 48 to move up or down as desired within valve bore 46. Knob 58 may be provided with graduations, as seen in the drawings, for the purpose of aiding the operator in adjusting the spray. It is to be understood that valve housing 44 need not be a separate element from spray tip housing 40. The elements are separate and distinct only because they perform different functions resulting in differing material requirements. Thus, spray tip housing 40, because it is not subjected to erosion forces, may be formed of a relatively soft metal. Valve housing 44 as well as stem 50 on the other hand are subjected to substantial erosion forces and should be formed of an erosion-resistant material, such as tungsten carbide.

Figure 3:
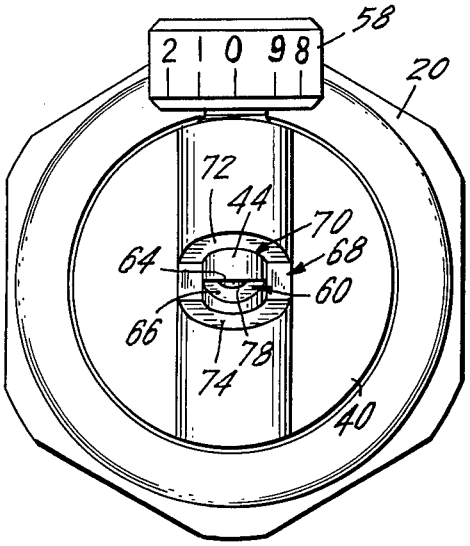
FIG. 3 is a front elevational view of a portion of the spray gun of FIG. 1 showing primarily the spray tip according to the present invention.
Figure 4:
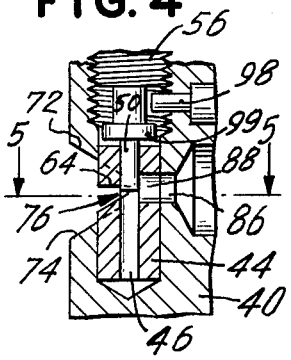
FIG. 4 is a broken-away portion of the spray tip according to the present invention as shown in FIG. 2.

A groove, generally designated 60, is provided in valve housing 44 which intersects bore 46 thereby forming opening 62. Groove 60 is defined by upper and lower faces, designated 64 and 66, respectively. Spray tip housing 40 is additionally provided with a groove, designated 68, at its paint-exiting end which intersects bore 52 to form opening 70 and is defined by upper and lower faces 72 and 74, respectively. Valve housing 44 is press fit into bore 52 so that groove 60, which forms opening 62, coincides with opening 70 which, as clearly seen in FIGS. 2, 3 and 4, is substantially larger than opening 62 so as not to interfere with the exiting fan spray. Thus, spray opening 76 is formed by the lower edge 78 of opening 62 and the forward-facing edge of the bottom face 80 of valve stem 50.

Liquid paint under high pressure is supplied to valve bore 46 via fluid bore 82 which communicates at its upstream end with valve port 30 and at its downstream end with valve bore 46. Gasket 84 is provided between spray tip 18 and valve 24 in order to prevent leakage thereat. In the embodiment of FIGS. 1 to 6, fluid bore 82 is provided at its downstream end with a restricted bore 86 which communicates with bore 52 into which valve housing 44 is fitted. Valve housing 44 is provided with bore 88 which substantially coincides with bore 86, as clearly seen in FIGS. 2, 4 and 5. Preferably, fluid bore 82 intersects valve bore 46 via bore 88 in valve housing 44 opposite opening 62 to thereby direct the liquid paint so that it impinges on spray opening 76 in a substantially axial direction. In addition, it has been found that for proper operation, the cross-sectional areas of bores 82, 86, 88 and 26 and valve port 30 must be greater than opening 62 so that when spray opening 76 is open to its greatest extent, the fluid impinging on spray opening 76 embraces the entire opening. It is to be understood, however, that the basic requisite is to deliver the pressurized liquid paint to valve bore 46 so that it may be forced through spray opening 76. Thus, fluid bore 82 may be alternatively positioned without significantly affecting the operation of the present invention.

In order to prevent the operator from accidentally removing valve means 48 from spray tip 18, a stop means, generally designated 90, is inserted into bore 92 in housing 40. Bore 92 is threaded at 94 and stop means 90 is threaded at 96 to that when stop means 90 is screwed into bore 92, stem 98 is inserted into bore 52 above stop 99 on valve means 48. Stop 99 is positioned such that valve stem 50 may be retracted in valve bore 46 no further than to fully open spray opening 62, as clearly seen in FIGS. 2 and 4.

In operation, the liquid paint under high pressure is introduced to spray gun 10 by means of conduit 22 and completely fills fluid passage 26 in spray portion 16. The operator selects the volume of paint desired to be sprayed by rotating knob 58, thereby retracting valve stem 50 in valve bore 46 from the closed position depicted in FIG. 2 to a partially open position, such as depicted in FIG. 4. As clearly seen in FIGS. 2, 4 and 6, groove 60 may be formed such that lower face 66 is angulated below the horizontal axis of spray gun 10 thereby resulting in lower edge 78 of opening 62 having a concave shape as seen in FIG. 3. Thus, in addition to adjusting or controlling the spray volume, the operator may also simultaneously control the spray width since, as stem 50 is moved upwardly in valve bore 46, the diameter of spray opening 76 is increased.

Once the operator has chosen the spray he wishes by adjusting spray opening 76, he merely depresses trigger 36 which causes valve stem 34 to be moved axially rearwardly and away from valve 24, thereby unseating ball valve 32 and opening valve port 30. Liquid paint under high pressure now enters spray tip 18 and completely fills liquid bore 82 and valve bore 46 below valve stem 50. As a result of the high pressure, the paint is forced through spray opening 76 and because of the pressure drop and the substantially sharp edges of opening 76 the liquid paint is atomized and exits from the spray tip at a high velocity. It has been found that in order to produce a fan spray which is substantially axial with respect to spray gun 10, upper face 64 of groove 60 should be in a horizontal plane parallel to the horizontal axis of the spray gun. It is believed that the spray exiting from spray opening 76 is given an upward direction because of the vertical inside wall at edge 78. Thus, as the upwardly directed spray strikes the horizontal surface of upper face 64 of groove 60, the spray is diverted to a substantially horizontal fan. In addition, it has been found that in order to create an acceptable fan spray, the outer edge of upper face 64 should be uniform, have a substantially sharp edge, and be rounded.

In the event that during operation a particle of paint is lodged in spray opening 76, it has been found that the operator may easily dislodge the particle and clear the tip in most cases without dismantling the spray tip. This is accomplished by opening spray opening 76 to its full extent which should, in most cases, permit the particle to pass through the opening because of the pressure in fluid bore 82 and valve bore 46. A benefit of the present invention which has been discovered is that during this clearing operation, the liquid which issues from spray opening 76 does so in the form of a fan spray, thus not requiring the operator to re-direct the spray gun in order to avoid adulterating the paint finish.

It may be necessary at times to remove and replace valve means 48 due to excessive wear of valve stem 50. In such event, spray tip 18 is removed by the unscrewing of nut 20 and valve means 48 is easily removed by unscrewing it from housing 40 after withdrawing stem 98 of stop means 90. It is to be appreciated in this connection that when a new valve means 48 is introduced, the upper edge of spray opening 76 is thereby renewed. In addition, as knob 58 is turned, a different portion of the edge of the bottom face 80 of valve stem 50 is presented as the upper edge of spray opening 76. Thus, it can be appreciated that the usable life of such a spray tip will be substantial.

Referring now to the embodiment depicted in FIGS. 7 to 11, there is shown a modified and preferred form of the invention described above. It has been found during operation of the spray tip according to FIGS. 1 to 6, wherein an axial fan spray is desired, and thus upper face 64 of groove 60 is horizontal, the quality of the spray is dependent on the condition of upper face 64 and edge 78 rather than the forward-facing edge of bottom face 80 of stem 50 and edge 78. Thus, great care is required in preparing upper face 64 to insure that there are no imperfections that would disturb the quality of the spray and cause the finish to be imperfect. In addition, it is necessary to maintain face 64 continuously free of paint build-up during use since this also tends to interfere with the quality of the spray. Thus, it was found that if certain adjustments or changes were made in the positioning of the adjustable valve, an axially directed fan spray would result without the exiting spray contacting the upper face 64 of groove 60. In FIG. 7, there is shown a spray tip of the preferred form, designated 118, wherein the adjustable spray valve 142, rather than being positioned perpendicularly with respect to the horizontal axis of the spray gun, is angularly positioned so as to form an acute angle with respect to the forward direction of the axis of the spray gun. Thus, bore 152, into which valve housing 144 is press fit, is formed in spray tip housing 140 near its forward face at an acute angle with respect to the axial direction of the spray gun. Grooves 160 and 168 are formed in valve housing 144 and the forward face of spray tip housing 140, respectively, and as clearly seen in FIG. 7, may be formed coincidentally with each other to result in opening 162 in valve bore 146.

In order to provide pressurized fluid to valve bore 146, a fluid bore 182 is provided in spray tip housing 140 which communicates at its upstream end with valve port 130 and at its downstream end with restricted bore 186. Restricted bore 186 in turn communicates at its downstream end with valve bore 146 by means of bore 188 in valve housing 144. Bore 188 is preferably provided opposite opening 162 in valve bore 146 so that pressurized fluid is supplied substantially axially to spray opening 176. Preferably, the cross-sectional areas of bores 182, 186, 188 and 126 and valve port 130 are greater than opening 162, as clearly seen in FIGS. 7, 10 and 11, so that when spray opening 176 is open to its greatest extent, axially directed fluid in bore 188 impinges on face 180 of stem 150 and on valve bore 146 at edge 178 to thereby embrace the entirety of spray opening 176. It has also been found preferable to position lower face 166 of groove 160 below the horizontal plane determined by the axis of the spray gun and upper face 164 above this plane. In this manner, paint build-up on these surfaces is substantially avoided.

It is believed that an axially directed fan spray results from this construction because of the directions imposed on the fluid at the spray opening 176. Turning to FIGS. 9, 10 and 11, it can be seen that a portion of the axially directed pressurized fluid in bore 188 of valve housing 144 impinges on angulated face 180 of stem portion 150, thus giving this portion of the fluid a partial downward direction, and simultaneously a portion of the fluid impinges on the angulated portion of valve bore 146 at edge 178 of spray opening 176, thus giving this portion of the fluid a partial upward direction. The result of these two partial directional attitudes imparted to the fluid at spray opening 176 is to cause the fluid exiting in the form of a fan spray to do so substantially axially with respect to the spray gun. It is to be appreciated that a number of factors are involved in determining the direction of the fan spray in addition to the particular angular attitude of adjustable spray valve 142. Thus, the particular configuration of groove 160 as well as the positioning of bore 188 are additional determining factors.

The spray tip in FIG. 12, generally designated 218, is a further embodiment of the present invention and demonstrates how pressurized fluid may be delivered to valve bore 246 without the provision of a bore for that purpose in valve housing 244. Thus, fluid bore 282, instead of intersecting valve bore 246, is positioned so as to communicate with the lower portion of bore 252 below valve housing 244, thereby communicating with valve bore 246 and establishing a continuous fluid path. In this form it has been found necessary to angulate upper face 272 of groove 268 to a greater extent than upper face 264 of groove 260. This is necessitated because the fluid exiting from spray opening 276 does so in an upwardly direction to impinge upon upper face 264 of groove 260 which results in a substantially axial fan spray. If the fluid exiting from spray opening 276 impinges on upper face 272, it has been found that the direction of the fan spray tends to vary during adjustment.

It is to be understood that the foregoing general and detailed descriptions are explanatory of the present invention and are not to be interpreted as restrictive of the scope of the following claims.

What is claimed is:

1. An adjustable spray nozzle for use with a spray gun, said spray gun being adapted for hydraulically atomizing and spraying liquids and including conduit means communicating with a source of liquid under pressure, said adjustable spray nozzle comprising:

a. a spray tip housing including means for securing said housing to said spray gun;

b. a fluid bore in said housing communicating with said conduit means and terminating in a spray opening in said housing having substantially sharp edges to thereby permit the transference of pressurized liquid from said source to said spray opening; and c. valve means included in said spray tip housing for varying the size of said spray opening from a closed position to a fully open position including all intermediate positions therebetween to thereby adjust the spray of liquid issuing from said spray opening.

2. The adjustable spray nozzle as defined in claim 1 wherein the valve means for varying the size of the spray opening comprises a slide valve transversely movable in said spray opening and forming a part thereof.

3. An adjustable spray nozzle for use with a spray gun, said spray gun being adapted for hydraulically atomizing and spraying liquids and including conduit means communicating with a source of liquid under pressure, said adjustable spray nozzle comprising:

a. a spray tip housing including means for securing said housing to said spray gun;

b. a valve bore extending partially through said housing;

c. a groove formed in said housing and intersecting the side wall of said valve bore to thereby form an opening therein having substantially sharp edges;

d. A fluid bore in said housing communicating with said conduit means and said valve bore to thereby permit the transference of pressurized liquid from said source to said valve bore;

e. a valve stem extendable into said valve bore and having a bottom face defining a substantially sharp edge with said stem; and f. means for adjustably moving said valve stem in said valve bore to vary the opening in said valve bore and thereby defining a spray opening having substantially sharp edges.

4. The adjustable spray nozzle as defined in claim 3 wherein the fluid bore in said housing communicates with said valve bore such that the pressurized liquid transferred to said valve bore inpinges upon said spray opening in a direction substantially parallel to the axis of said spray gun.

5. The adjustable spray nozzle as defined in claim 4 wherein the fluid bore in said housing communicates with said valve bore by means of an opening in said valve bore oppositely positioned from said opening in said valve bore formed by said groove.

6. The adjustable spray nozzle as defined in claim 5 wherein the opening in said valve bore with which the fluid bore communicates and the fluid bore have cross-sectional areas greater than the opening in said valve bore formed by the groove in said housing to thereby cause the liquid impinging on said spray opening in said valve bore to embrace the entirety of said spray opening.

7. The adjustable spray nozzle as defined in claim 3 wherein said valve bore and said valve stem have elongated substantially circular configurations at said opening in said valve bore formed by the groove in said housing.

8. The adjustable spray nozzle as defined in claim 7 wherein the means for adjustably moving said valve stem in said valve bore comprises a female screw thread in said valve bore near its open end and a male screw thread engageable therewith on the upper portion of said valve stem and further including means at the upper end of said valve stem for turning said valve stem.

9. The adjustable spray nozzle as defined in claim 3 wherein the valve bore extending partially through said housing is substantially perpendicular to the plane of the horizontal axis of said spray gun.

10. The adjustable spray nozzle as defined in claim 9 wherein the upper surface of the groove in said housing is in a horizontal plane parallel to the plane of the horizontal axis of the spray gun and is provided with a rounded forward edge.

11. The adjustable spray nozzle as defined in claim 9 wherein the lower surface of the groove in said housing is in a plane angulated below the plane of the horizontal axis of said spray gun.

12. The adjustable spray nozzle as defined in claim 3 wherein the valve bore extending partially through said housing is positioned in the plane of the vertical axis of the spray gun and forms an acute angle with the forward direction of the horizontal axis of the spray gun.

13. The adjustable spray nozzle as defined in claim 12 wherein the upper surface of the groove in said housing is in a plane angulated slightly above the plane of the horizontal axis of the spray gun.

14. The adjustable spray nozzle as defined in claim 8 which further comprises removable stop means in said housing engageable with stop means on said valve stem for limiting the travel of said valve stem in said valve bore between a position closing said spray opening and a position fully opening said spray opening.

* * * * *